US007047201B2

(12) United States Patent
Chang

(10) Patent No.: US 7,047,201 B2
(45) Date of Patent: May 16, 2006

(54) REAL-TIME CONTROL OF PLAYBACK RATES IN PRESENTATIONS

(75) Inventor: Kenneth H. P. Chang, Foster City, CA (US)

(73) Assignee: SSI Corporation, Tokyo (JP)

( * ) Notice: Subject to any disclaimer, the term of this patent is extended or adjusted under 35 U.S.C. 154(b) by 754 days.

(21) Appl. No.: 09/849,719

(22) Filed: May 4, 2001

(65) Prior Publication Data

US 2002/0165721 A1 Nov. 7, 2002

(51) Int. Cl.
*G10L 21/04* (2006.01)

(52) U.S. Cl. ..... 704/503; 704/504; 704/221

(58) Field of Classification Search ..... 704/229, 704/205, 500, 211, 503–504, 221, 267; 386/75; 715/500.1; 84/603; 709/231, 246
See application file for complete search history.

(56) References Cited

U.S. PATENT DOCUMENTS 5,546,395 A 8/1996 Sharma et al.

(Continued)

FOREIGN PATENT DOCUMENTS

EP 0 895 427 A2 2/1999

(Continued)

OTHER PUBLICATIONS

Chen, Herng-Yow et al., "Design of a Web-based Synchronized Multimedia Lecture System for Distance Education," Multimedia Computing And Systems, 1999, IEEE Intl. Conf. in Florence, Italy , pp. 887-891 (Jun. 7-11, 1999).

(Continued)

*Primary Examiner*—W. R. Young
*Assistant Examiner*—Huyen X. Vo
(74) *Attorney, Agent, or Firm*—David T. Millers

(57) ABSTRACT

Media encoding, transmission, and playback processes and structures employ a multi-channel architecture with different audio channels corresponding to different playback rates for a presentation to be transmitted over a network. Audio frames in the various audio channels all correspond to the same amount of time in the original presentation and have frame indexes that identify in the different audio channels the frames corresponding to the same time interval in the presentation. A user can make a real-time change in playback rate causing selection of a channel corresponding to the new playback rate and a frame required for prompt and smooth transition in the playback rate of the presentation. The architecture can additionally provide channels for graphics data such as image data that are displayed according to the index of the audio, and different audio channels with the same playback rate but different compression schemes for use according to available bandwidth on the network.

10 Claims, 7 Drawing Sheets

U.S. PATENT DOCUMENTS 5,638,365 A 6/1997 Duault et al.
5,664,044 A * 9/1997 Ware ..... 386/75
5,859,641 A 1/1999 Cave
5,886,276 A * 3/1999 Levine et al. ..... 84/603
5,923,853 A 7/1999 Danneels
5,953,506 A 9/1999 Karla et al.
5,974,380 A * 10/1999 Smyth et al. ..... 704/229
5,995,091 A * 11/1999 Near et al. ..... 715/500.1
5,996,022 A 11/1999 Krueger et al.
6,005,600 A 12/1999 Hill
6,035,336 A 3/2000 Lu et al.
6,078,594 A 6/2000 Anderson et al.
6,084,919 A 7/2000 Kleider et al.
6,122,338 A 9/2000 Yamauchi
6,151,632 A 11/2000 Chaddha et al.
6,182,031 B1 1/2001 Kidder et al.
6,484,137 B1 * 11/2002 Taniguchi et al. ..... 704/211
6,622,171 B1 * 9/2003 Gupta et al. ..... 709/231

FOREIGN PATENT DOCUMENTS

WO WO 00/60864 A1 10/2000

OTHER PUBLICATIONS

Sampath-Kumar, Srihari et al., "WebPresent—A World Wide Web based telepresentation tool for physicians," Proc. Of the SPIE—The Intl. Soc. For Optical Engineering, Medical Imaging 1997: Image Display, vol. 3031, pp. 490-499 (Feb. 23-25, 1997).

Omoigui et al., "Time-Compression: System Concerns, Usage, and Benefits", ACM SIGCHI Conference on Human Factors in Computing Systems, May 1999.

* cited by examiner

REAL-TIME CONTROL OF PLAYBACK RATES IN PRESENTATIONS

BACKGROUND

A multi-media presentation is generally presented at its recording rate so that the movement in video and the sound of audio are natural. However, studies indicate that people can perceive and understand audio information at playback rates much higher rates, e.g., up to three or more times higher than the normal speaking rate, and receiving audio information at a rate higher than the normal speaking rate provides a considerable time savings to the user of a presentation.

Simply speeding up the playback rate of an audio signal, e.g., increasing the rate of samples played from a digital audio signal, is undesirable because the increase in playback rate changes the pitch of the audio, which makes the information more difficult to listen to and understand. Accordingly, time-scaled audio techniques have been developed that increase the information transfer rate of audio information without raising the pitch of the audio signal. A continuously variable signal processing scheme for digital audio signals is described in U.S. patent application Ser. No. 09/626,046, entitled "Continuously Variable Scale Modification of Digital Audio Signals," filed Jul. 26, 2000, which is hereby incorporated by reference in it entirety.

A desirable user convenience would be the ability to change the rate of information, for example, according to the complexity of the information, the amount of attention the user wants to devote to listening, or the quality of the audio. One technique for changing the audio information rate for playback of digital audio is to correspondingly change the digital data rate that the sender transmits and employ a processor or converter at the receiver that processes or converts the data as required to preserve the pitch of the audio.

The above technique can be difficult to implement in a system conveying information over a network such as a telephone network, a LAN, or the Internet. In particular, a network may lack the capability to change the data rate of transmission from a source to the user as required for the change in audio information rate. Transmitting unprocessed audio data for time scaling at the receiver is inefficient and places an unnecessary burden on the available bandwidth because the process of time scaling with pitch restoration discards much of the transmitted data. Additionally, this technique requires that the receiver have a processor or converter that can maintain the pitch of the audio being played. A hardware converter increases the cost of the receiver's system. Alternatively, a software converter can demand a significant portion of the receiver's available processing power and/or battery power, particularly in portable computers, personal digital assistants (PDAs), and mobile telephones where processing and/or battery power may be limited.

Another common problem for network presentations that include video is the inability of the network to maintain the audio-video presentation at the required rate. Generally, the lack of sufficient network bandwidth causes intermittent breaks or pauses in the audio-video presentation. These breaks in the presentation make the presentation difficult to follow. Alternatively, images in a network presentation can be organized as a linked series of web pages or slides that a user can navigate at the user's rate. However, in some network presentations such as tutorials, exams, or even commercials, the timing, sequence, or synchronization of visual and audible portions of the presentation may be critical to the success of the presentation, and the author or source of the presentation may require control of the sequence or synchronization of the presentation.

Processes and systems are sought that can present a presentation in an ordered and uninterrupted manner and give a user the freedom to select and change an information rate without exceeding the capabilities of a network transferring the information and without requiring the user to have special hardware or a large amount of processing power.

SUMMARY

In accordance with an aspect of the invention, a source of a digital presentation to be transmitted over a network such as a telephone network, a LAN, or the Internet, pre-encodes the presentation in a data structure having multiple channels. Each channel contains a different encoding of the portion of the presentation that changes according to the time scaling and/or the data compression of the presentation.

In one particular embodiment, the audio portion of the presentation is encoded differently in several channels according to the time scaling and data compression of the channels. Each encoding divides the presentation into audio frames that have a known timing relation according to the frame index values of the audio frames. Accordingly, when a user changes playback rates, the data stream switches from a current channel to a channel corresponding to the new time scale and accesses a frame from the new channel according to the current frame index.

In one embodiment, each frame corresponds to a fixed period of time in the presentation when played at the normal rate. Accordingly, each channel has the same number of frames, and information in each frame corresponds to a time interval that a frame index for the frame identifies. The source transmits a frame that corresponds to a current time index for the playback of the presentation and is in a channel corresponding to the user's selection of a playback rate.

In accordance with another aspect of the invention, two or more channels of the file structure correspond to the same playback rate but differ in respective compression processes applied to the data in the channels. The source or receiver can automatically select the channel that corresponds to the user-selected playback rate and does not exceed the transmission bandwidth available on the network carrying data to the receiver.

In accordance with yet another aspect of the invention, presentation includes bookmarks and associated graphics data such as image data that are encoded separately from the channels associated with audio data. Each bookmark has an associated range of frame indices or times. A display application allows a user to jump to the start of the range associated with any bookmark, and the source transmits the bookmarks data (e.g., graphics data) over the network to the user for use (e.g., display) at the appropriate time, typically at the beginning of the next audio frame.

Another embodiment of the invention is an authoring tool or method that permits an author to construct a presentation having graphics such as displayed text, slides, or web pages synchronized according to the audio content, which synchronization is preserved regardless of the playback rate of audio. The authoring tool can be used in commercial or personal messaging and creates a presentation that can be up-loaded to and used from any network server implementing a conventional network file protocol such as http.

Using a presentation in accordance with the present invention, the author or source of a presentation can control the sequence of images and the synchronization of images with audio. Additionally, the presentation provides a lower-bandwidth alternative to conventional streamed video. In particular, a low bandwidth system that cannot support transmission of video typically can support the audio portion of the presentation and display images when required to provide visual cues illustrating key points of the presentation.

BRIEF DESCRIPTION OF THE DRAWINGS

Use of the same reference symbols in different figures indicates similar or identical items.

DETAILED DESCRIPTION

In accordance with an aspect of the invention, media encoding, network transmission, and playback processes and structures use a multi-channel architecture with different channels corresponding to different playback rates or time scales of a portion of a presentation. An encoding process for the presentation uses multiple encodings of the same portion such as the audio portion of the presentation. Accordingly, different channels have different encodings for different playback rates or time scales, even though the different channels represent the same portion of the presentation.

A receiver or user of the presentation can select the playback rate or time scale and thereby selects use of a channel corresponding to that time scale. The receiver does not require a complex decoder or a powerful processor to achieve the desired time scale because the selected channel contains information pre-encoded for the selected time scaling. Additionally, the required network bandwidth does not increase as in systems were the receiver performs time scaling because pre-encoding or time scaling of audio data removes redundant audio data before transmission. Accordingly, bandwidth requirements can remain constant regardless of the time scale.

Each channel contains a series of frames that are indexed according to the order of the presentation, and when a user changes from one channel to another, the frame from the new channel can be identified and transmitted when required for continuous uninterrupted play of the presentation. In an exemplary embodiment, corresponding audio frames in different audio channels correspond to the same amount of time in the presentation when played at normal speed and have frame indices that identify the frames as corresponding to particular time intervals in the presentation. A user can change a playback rate causing selection and transmission of a frame from a channel corresponding to the new playback rate, and the user receives the frame when required for a real-time transition in the playback rate of the presentation.

The architecture can additionally provide for data channels for graphics data such as text, images, HTML descriptions, and links or other identifiers for information available on the network. The source transmits the graphics data according to the time index of the presentation or a user's request to jump to a particular bookmark in the presentation. A file header can provide the user with information describing the bookmarks.

The architecture can further provide different audio channels with the same playback rate but different compression schemes for use according to the condition of the network transmitting data.

Figure 1:
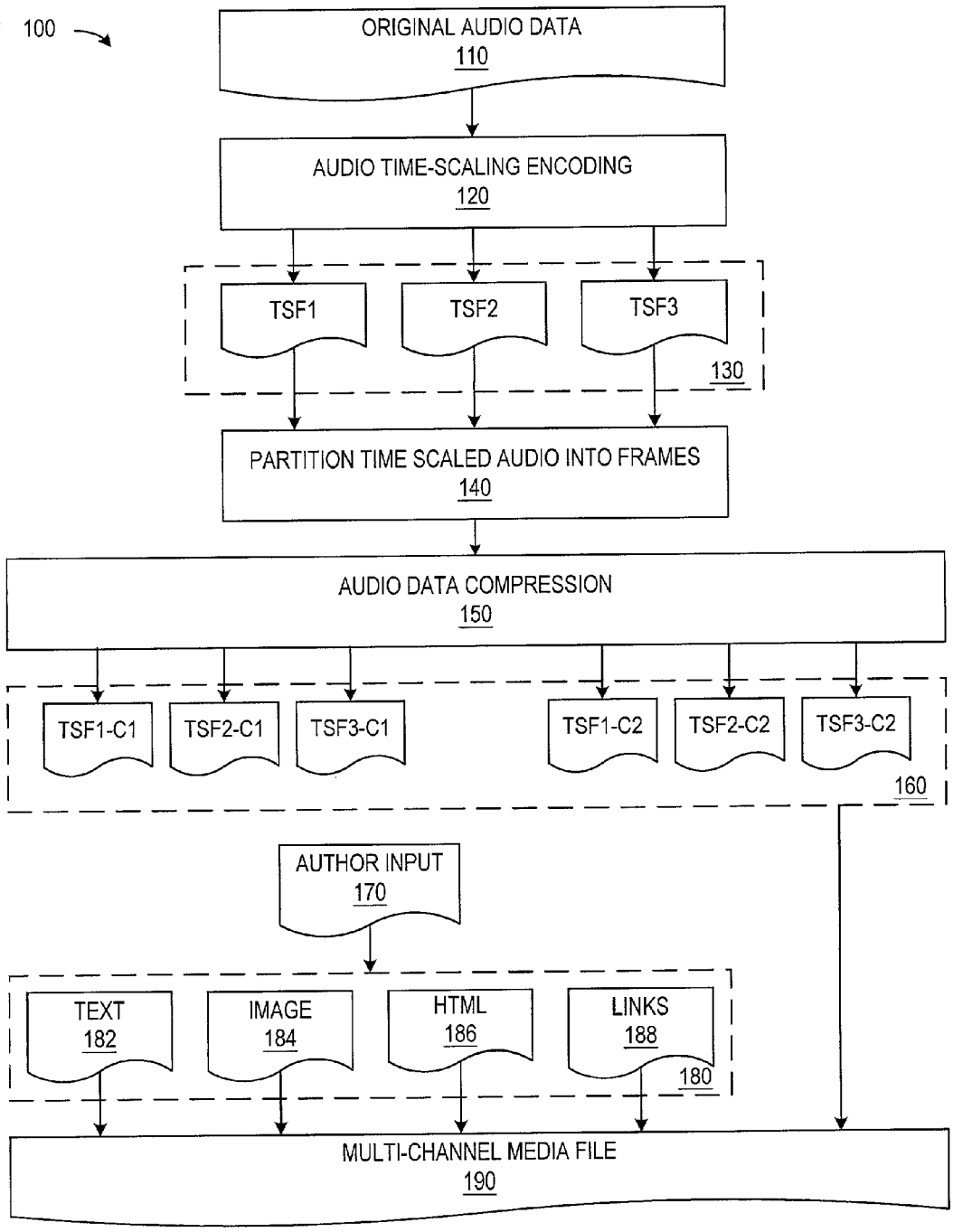
FIG. 1 is a flow diagram illustrating a process for generating a multi-channel media file in accordance with an embodiment of the invention.

FIG. 1 illustrates a process 100 for generating a multi-channel media file 190 in accordance with an embodiment of the invention. Process 100 starts with original audio data 110, which can be in any format. In the exemplary embodiment, original audio data 110 are in a ".wav" file, which is a series of digital samples representing the waveform of an audio signal.

An audio time-scaling process 120 performed on original audio data 110 generates multiple sets TSF1, TSF2, and TSF3 of time-scaled digital audio data. Time-scaled audio data sets TSF1, TSF2, and TSF3 are time-scaled to preserve the pitch of the original audio when played back, but each data set TSF1, TSF2, or TSF3 has a different time scale. Accordingly, playback of each set takes a different amount of time.

In one embodiment, audio data set TSF1 corresponds to data for playback at the recording rate of original audio data 110 and may be identical to original audio data 110. Audio data sets TSF2 and TSF3 correspond to data for playback at two and three times the recording rate, respectively. Typically, audio data sets TSF2 and TSF3 will be smaller than audio data set TSF1 because audio data sets TSF2 and TSF3 contain fewer audio samples for playback at a fixed sampling rate. Although FIG. 1 shows three sets of time-scaled data, audio time-scale encoding 120 can generate any number of time-scaled audio data sets having corresponding playback rates. For example, seven sets corresponding to half-integer multiples of the recording rate between one and four. More generally, the author of a presentation can select which time scales are available to the user.

Audio time-scaling process 120 can be any desired time-scaling technique such as a SOLA-based time scaling process and could include a different time scaling technique for each time-scaled audio data set TSF1, TSF2, or TSF3 depending on the time scale factor. Typically, audio time-scaling process 120 uses a time scale factor as an input parameter and changes the time scale factor for each data set generated. An exemplary embodiment of the invention employs a continuously variable encoding process such as described in U.S. patent application Ser. No. 09/626,046, which is incorporated by reference above, but any other time scaling process could be used.

After audio time scaling process 120, a partitioning process 140 separates each of time-scaled audio data sets TSF1, TSF2, and TSF3 into audio frames. In the exemplary embodiment of the invention, each audio frame corresponds to the same interval of time (e.g., 0.5 seconds) of original audio data 110. Accordingly, each of the data sets TSF1, TSF2, and TSF3 has the same number of audio frames. The audio frames in the time-scaled audio data set having the greatest time scale factor require the shortest playback time and are generally smaller than frames for audio data sets undergoing less time scaling.

Other alternative partitioning processes can be employed. In one alternative embodiment, partitioning process 140 divides each of time-scaled audio data sets TSF1, TSF2, and TSF3 into audio frames that have the same duration during playback. In this embodiment, audio frames in different channels will have about the same size, but different channels will include different numbers of frames. Accordingly, identifying corresponding audio information in different frames, as is required when changing playback rates, is more complex in this embodiment than in the exemplary embodiment.

After partitioning process 140, an audio data compression process 150 separately compresses each frame, and the compressed audio frames resulting from audio data compression process 150 are collected into compressed audio files TSF1-C1, TSF2-C1, TSF3-C1, TSF1-C2, TSF2-C2, and TSF3-C2, referred to collectively as compressed audio files 160. Compressed audio files TSF1-C1, TSF2-C1, and TSF3-C1 all correspond to a first compression method and respectively correspond to time-scaled audio data sets TSF1, TSF2, and TSF3. Compressed audio files TSF1-C2, TSF2-C2, and TSF3-C2 all correspond to a second compression method and respectively correspond to time-scaled audio data sets TSF1, TSF2, and TSF3.

In accordance with an aspect of the invention illustrated in FIG. 1, audio data compression process 150 uses two different data compression methods or factors on each frame of time-scaled audio data. In alternative embodiments, audio data compression process 150 can use any number of data compressions methods on each frame of time-scaled audio data. A wide variety of suitable audio data compression methods are available and well known in the art. Examples of suitable audio compression methods include discreet cosine transform (DCT) methods and compression processes defined in the MPEG standards and specific implementations such as Truespeech from DSP Group of Santa Clara, Calif. As another alternative, a process may be developed that integrates audio time-scaling 120, framing 140, and compression 150 into a single interwoven procedure tailored for efficient compression of relatively small audio frames.

Each of the compressed audio files TSF1-C1, TSF1-C2, TSF2-C1, TSF2-C2, TSF3-C1, and TSF3-C2 corresponds to a different audio channel in multi-channel media file 190. Multi-channel media file 190 additionally contains data associated with bookmarks 180.

Author input 170 during creation of multi-channel media file 190 selects the bookmarks that are included in multi-channel media file 190. Generally, each bookmark includes an associated time or frame index range, identifying data, and presentation data. Examples of types of presentation data include but are not limited to data representing text 182, images 184, embedded HTML documents 186, and links 188 to web pages or other information available on the network for display as part of the presentation during the time interval corresponding to the associated range of the time or frame index. The identifying data identify or distinguish the various bookmarks as locations in the presentation to which a user can jump.

Author input 170 is not required for generation of multi-channel media file 190 in some embodiments of the invention. For example, multi-channel file 190 can be generated from original audio data 110 that represents one or more voice mail messages. Bookmarks can be created for navigation among the messages, but such messages generally do not require associated images, HTML pages, or web pages. A voice mail system can automatically generate a multi-channel file for a user's voice mail to permit user control of the playback speed of the messages. Use of the multi-channel file in a telephone network avoids the need for a receiver such as a mobile telephone to expend processing or battery power in changing the playback rate.

FIGS. 2A, 2B, 2C, 2D, and 2E illustrate a suitable format for multi-channel media file 190 and are described further below. The described formats are merely examples and are subject to wide variations in the size, order, and content of data structures.

Figure 2A:
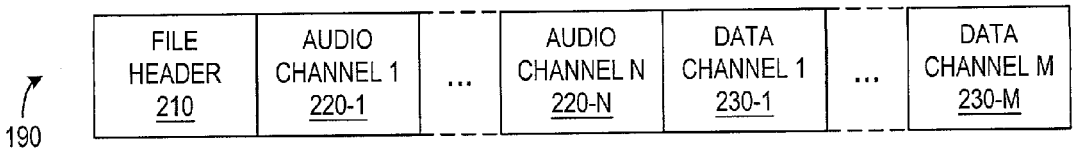
FIGS. 2A, 2B, 2C, 2D, and 2E illustrate the structure of a multi-channel media file, a file header for a multi-channel media file, an audio channel, an audio frame, and a data channel according to an embodiment of the invention.

In the broadest overview, multi-channel media file 190 includes a file header 210, N audio channels 220-1 to 220-N, and M data channels 230-1 to 230-M as shown in FIG. 2A. File header 210 identifies the file and contains a table of audio frames and data frames within channels 220-1 to 220-N and 230-1 to 230-M. Audio channels 220-1 to 220-N contain the audio data for the various time scales and compression methods, and data channels 230-1 to 230-M contain bookmark information and embedded data for display.

Figure 2B:
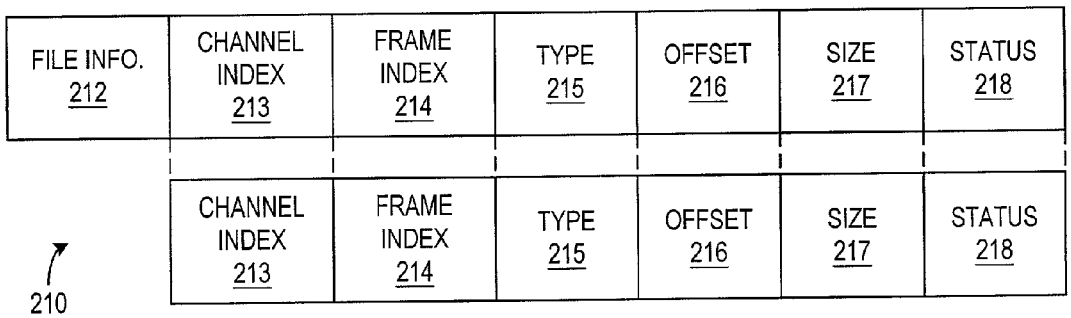

FIG. 2B represents an embodiment of file header 210. In this embodiment, file header 210 includes file information 212 that identifies multi-channel media file 190 and properties of the file as a whole. In particular, file header 210 can include a universal file ID, a file tag, a file size, and a file state field, and channel information indicating the number of, offset to, and size of audio and data channels 220-1 to 220-N and 230-1 to 230-M.

A universal ID in file header 210 indicates and depends on the contents of multi-channel file 190. The universal ID can be generated from the content of multi-channel media file 190. One method for generating a 64-byte universal ID performs a series of XOR operations on 64-byte pieces of multi-channel file 190. The universal file ID is useful when a user of a presentation starts the presentation during one session, suspends that session, and wishes to resume use of the presentation later. As described further below, multi-channel media file 190 may be stored on a one or more remote server, and the operator of the server might move or change the name of the presentation. When the user attempts to start the second session on the original or another server, the universal ID header from a file on the server can be compared to a cached universal ID in the user's system to confirm that the presentation is the one previously started even if the presentation was moved or renamed between sessions. The universal ID can alternatively be used to locate the correct presentation on a server. Audio frames and other information that the user's system may have cached during the first session can then be used when resuming the second session.

File header 210 also includes a list or table of all frames in multi-channel file 190. In the illustrated example, file header 210 includes a channel index 213, a frame index 214, a frame type 215, an offset 216, a frame size 217, and a status field 218 for each frame. Channel index 213 and frame index 214 identify the channel and display time of the frame. The frame type indicates type of frame, e.g., data or audio, the compression method, and the time scale for audio frames. Offset 216 indicates the offset from the beginning of multi-channel media file 190 to the start of the associated frame, and frame size 217 indicates the size of the frame at that offset.

As described further below, the user's system typically loads file header 210 from the server into the user's system. The user's system can use offsets 216 and sizes 217 when requesting specific frames from the server and use status fields 218 to track which frames are buffered or cached in the user's system.

Figure 2C:
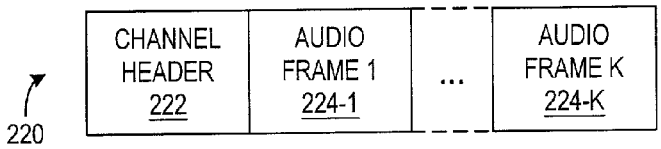

FIG. 2C shows a format for an audio channel 220. Audio channel 220 includes a channel header 222 and K compressed audio frames 224-1 to 224-K. Channel header 222 contains information regarding the channel as a whole including for example, a channel tag, a channel offset, a channel size, and a status field. The channel tag can identify the time scale and the compression method of the channel. The channel offset and size indicate the offset from the beginning of multi-channel file 190 to the start of the channel and the size of the channel beginning at that offset.

Figure 2D:
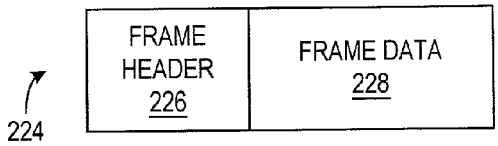

In the exemplary embodiment, all audio channels 220-1 to 220-N have K audio frames 224-1 to 224-K, but the sizes of the frames generally vary according to the time scale associated with the frame, the compression method applied to the frame, and how well the compression method worked on the data in specific frames. FIG. 2D shows a typical format for an audio frame 224. The audio frame 224 includes a frame header 226 and frame data 228. Frame header 226 contains information describing properties of the frame such as the frame index, the frame offset, the frame size, and the frame status. Frame data 228 is the actual time-scaled and compressed data generated from the original audio.

Data channels 230-1 to 230-M are for the data associated with bookmarks. In the exemplary embodiment, each data channel 230-1 to 230-M corresponds to a specific bookmark. Alternatively, a single data channel could contain all data associated with the bookmarks so that M is equal to 1. Another alternative embodiment of multi-channel media file 190 has one data channel for each type of bookmark, for example, four data channels respectively associated with text, images, HTML page descriptions, and links.

Figure 2E:
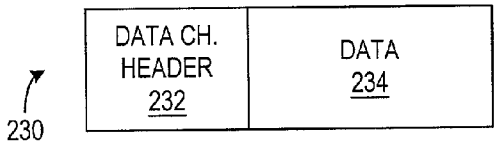

FIG. 2E illustrates a suitable format for a data channel 230 in multi-channel media file 190. Data channel 230 includes a data header 232 and associated data 234. Data header 232 generally includes channel information such as offset, size, and tag information. Data header 232 can additionally identify a range of times or a start frame index and a stop frame index designating a time or a set of audio frames corresponding to the bookmark.

Figure 3:
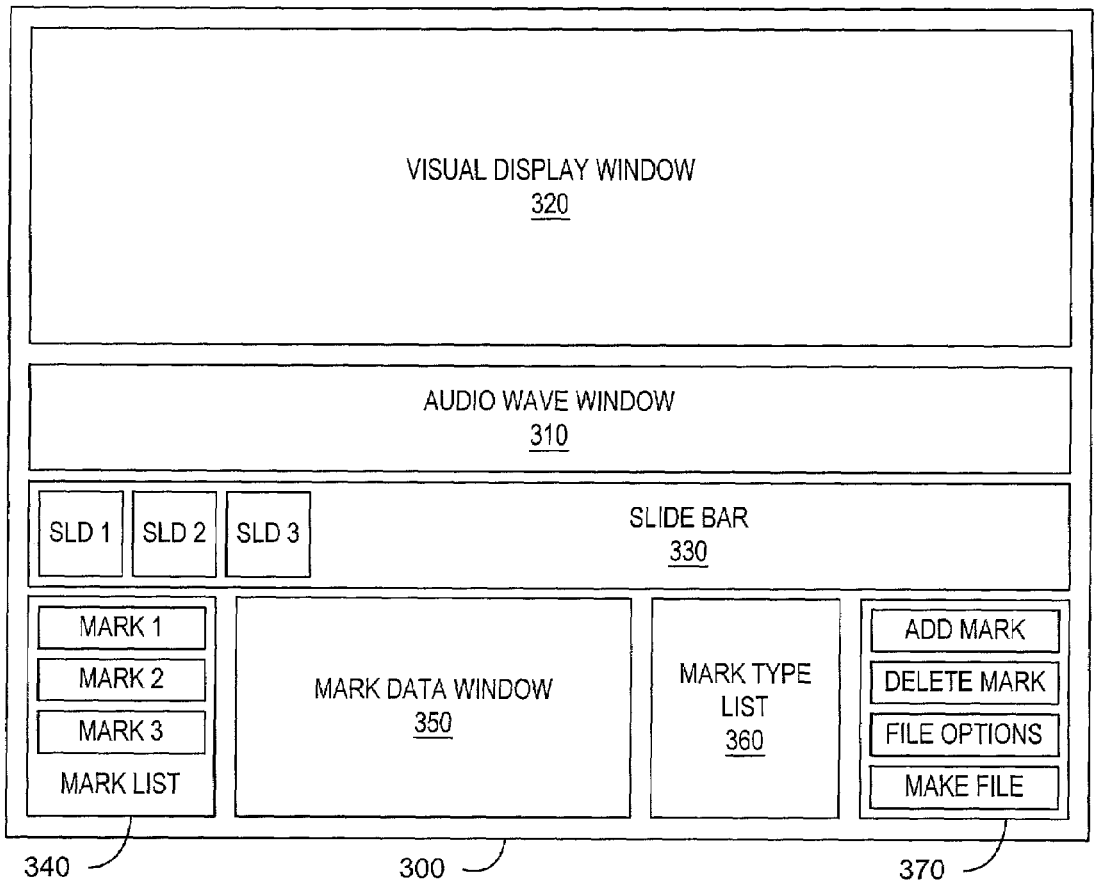
FIG. 3 illustrates a user interface of an authoring tool for creating presentations in accordance with an embodiment of the invention.

FIG. 3 illustrates a user interface 300 of an authoring tool used in generating a multi-channel media file 190 such as described above. The authoring tool permits input 170 for the creation of bookmarks and the attachment of visual information to original audio data 110 when creating a presentation. Generally, adding appropriate visual information can greatly facilitate understanding of a presentation when audio is played at a rate faster than normal speed because the visual information provides keys to understanding the audio portion of the presentation. Additionally, connection of graphics to the audio allows presentation of the graphics in an ordered manner.

User interface 300 includes an audio window 310, a visual display window 320, a slide bar 330, a mark list 340, a mark data window 350, a mark type list 360, and controls 370.

Audio window 310 displays a wave representing all or a portion of original audio data 110 during a range of times. When an author reviews a presentation, audio window 310 indicates the time index relative to original audio 110. The author use a mouse or other device to select any time or range of times relative to the start of the original audio data 110. Visual display window 320 displays the images or other visual information associated with a currently selected time index in original audio 110. Slide bar 330 and mark list 340 respectively contain thumbnail slides and bookmark names. The author can choose a particular bookmark for revisions or simply jump in the presentation to a time index associated with a bookmark by selecting the corresponding bookmark in mark list 340 or the corresponding slide in slide bar 330.

To add a bookmark, an author uses audio window 310, slide bar 330, or mark list 340 to select a start time for the bookmark, uses mark type list 360 for selection of a type for the bookmark, and uses controls 370 to begin the process of adding a bookmark of the selected type at the selected time. The details of adding a bookmark will generally depend on the type of information associated with the bookmark. For illustrative purposes, the addition of an embedded image associated with a bookmark is described in the following, but the types of information that can be associated with a bookmark is not limited to embedded images.

Adding an embedded image requires the author to select the data or file that represents the image. The image data can have any format but is preferably suitable for transmission over a low bandwidth communication link. In one embodiment, the embedded images are slides such as created using Microsoft PowerPoint. The authoring tool embeds or stores the image data in the data channel of multi-channel media file 190.

The author gives the bookmark a name that will appear in mark list 340 and can set or change the range of the audio frame index values (i.e., the start and end times) associated with the bookmark and the image data. When the presentation is played, visual display window 320 displays the image associated with a bookmark during playback of any audio frame having a frame index in the range associated with the bookmark.

The authoring tool adds to slide bar 330 a thumbnail image based on the image associated with the bookmark. When the author makes the multi-channel file, the bookmark's name, audio index range, and thumbnail data are stored as identifying data in multi-channel media file 190 at locations that depend on the specific format of multi-channel media file 190, for example, in file header 210 or in data channel header 232. As described further below, initialization of a user's system for a presentation may include accessing and displaying the mark list and slide bar for use when the user jumps to bookmark locations in the presentation.

Bookmarks associated with other types of graphics data such as text, an HTML page, or a link to network data (e.g., a web page) are added in a similar manner to bookmarks associated with embedded image data. For the various types of graphics data, mark data window 350 can display the graphics data in a form other than the appearance of the data in visual display window 320. Mark data window 350, for example, can contain text, HTML code, or a link, while visual display window 320 shows the respective appearance of the text, an HTML page, or a web page.

After the author finishes adding bookmarks and related information, the author uses controls 370 to cause creation of multi-channel file 190, for example, as illustrated in FIG. 1. The author can select one or more time-scales that will be available for the audio in the multi-channel file.

Figure 4:
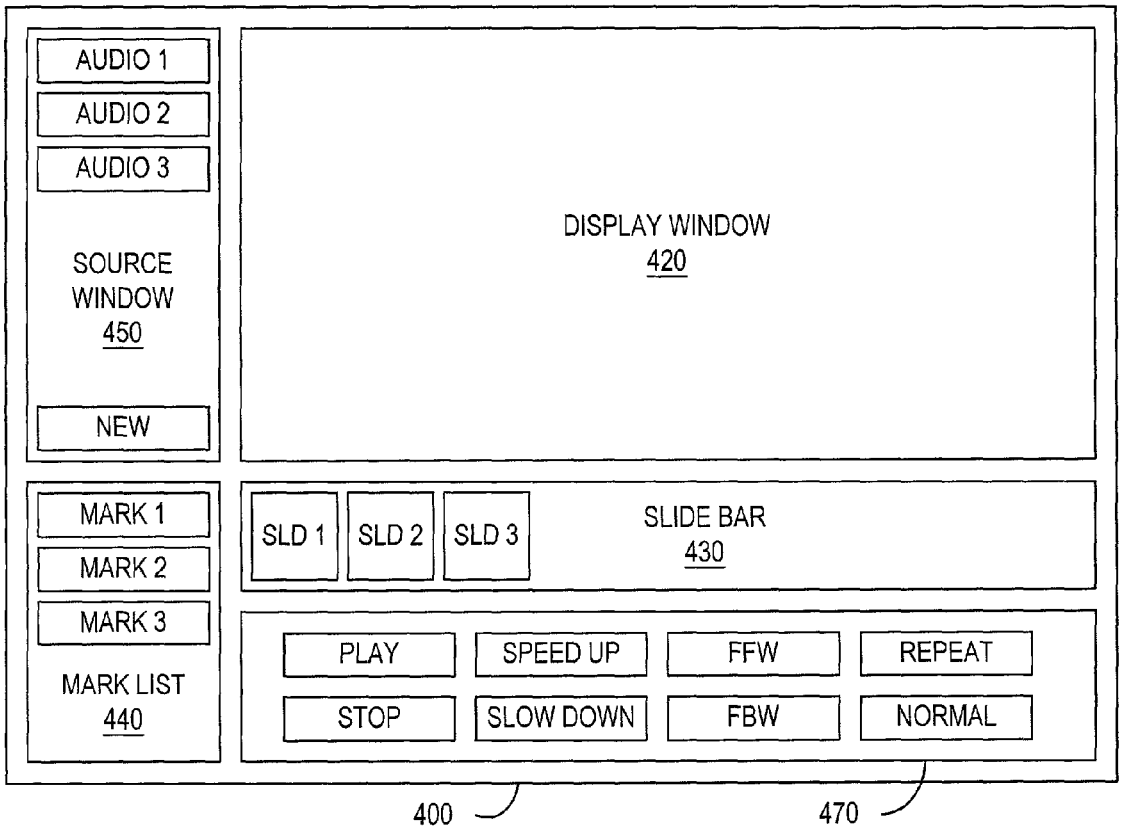
FIG. 4 illustrates a user interface of an application for accessing and playing presentations in accordance with an embodiment of the invention.

FIG. 4 illustrates a user interface 400 in a system for viewing a presentation in accordance with an embodiment of the invention. User interface 400 includes a display window 420, a slide bar 430, a mark list 440, a source list 450, and a control bar 470. Source window 450 provides a list of presentations for a user's selection and indicates the currently selected presentation.

Control bar 470 allows general control of the presentation. For example, the user can start or stop the presentation, speed up or slow down the presentation, switch to normal speed, fast forward or fast backward (i.e., jump ahead or back a fixed time), or activate an automatic repeat of all or a portion of the presentation.

Slide bar 430 and mark list 440 identify bookmarks and allow the user to jump to the bookmarks in the presentation.

Display window 420 is for visual content such as text, an image, an html page, or a web page that is synchronized with the audio. With properly selected visual content, the user of the presentation can more readily understand the audio content, even when the audio is played at high rate.

Figure 5:
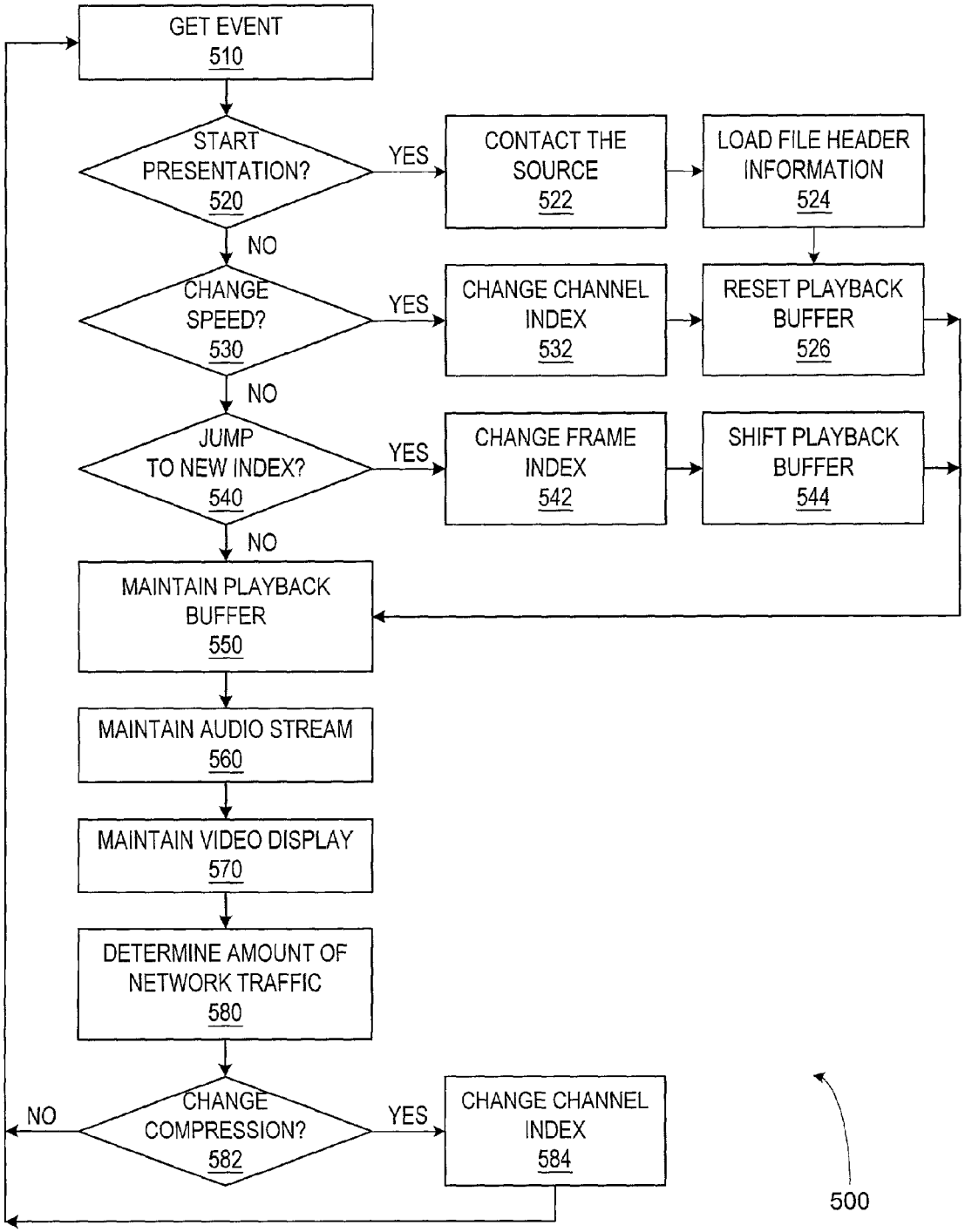
FIG. 5 is a flow diagram of a playback operation in accordance with an embodiment of the invention.

FIG. 5 is a flow diagram of an exemplary process 500 implementing a presentation player having the user interface of FIG. 4. Process 500 can be implemented in software or firmware in a computing system. In step 510, process 500 gets an event that may be no event or a user's selection via the user interface of FIG. 4.

Decision step 520 determines whether the user has started new presentation. A new presentation is a presentation for which header information has not been cached. If the user has started a new presentation, process 500 contacts the source of the presentation in a step 522 and requests file header information. The source would typically be a device such as a server connected to a user's computer via a network such as the Internet.

When the source returns the requested header information, a step 524 loads the header information as required for control of operations such as requesting and buffering frames of the presentation. In particular, step 526 resets a playback buffer, which may have contained frames and data for another presentation.

After step 526 resets the playback buffer, a step 550 maintains the playback buffer. Generally, step 550 maintains the playback buffer by identifying a series of audio frames that will be sequentially played if the user does not change the frame index or playback rate, determining whether any of the audio frames in the series are available in a frame cache, and sending requests to the source for audio frames in the series but not in the frame cache.

In an Internet embodiment of the invention, process 500 uses the well-known http protocol when requesting specific frames or data from the server. Accordingly, the server does not require a specialized server application to provide the presentation. However, an alternative embodiment could provide better performance by employing a server application to communicate with and push data to the user.

When the user receives an audio frame from the source, process 500 buffers or caches the audio frame but only queues the audio frame in the playback buffer if the frame is in the series to be played. If an audio frame to be played is queued in the playback buffer, a step 560 maintains audio output using a data stream decompressed from a frame in the playback buffer. Process 500 pauses the presentation if the required audio frame is not available when the audio stream switches from one frame index to the next.

A step 570 maintains the video display. Application 500 requests the graphics data from a location indicated in the header for the presentation. In particular, if the graphics data represent text, an image or html page embedded in the multi-channel file, process 500 requests graphics data from the source and interprets the graphics data according to its type. If the graphics data is network data such as a web page identified by a link in the multi-channel file, process 500 accesses the link to retrieve the network data for display. If network conditions or other problems cause the graphics data to be unavailable when required, process 500 continues to maintain the audio portion of the presentation. This avoids complete disruption of the presentation when network traffic is high.

In a step 580, process 500 determines the amount of network traffic or available bandwidth. The network traffic or bandwidth can be determined from the speed at which the source provides any requested information or the state of frame buffers. If network traffic is too high to provide data at the required rate for smooth playback of the presentation, process 500 decides in a step 584 to change a channel index for the presentation to select a channel that requires less bandwidth (i.e., employs more data compression) but still provides the user's selected audio playback speed. If network traffic is low, step 584 can change the channel index for the presentation to select a channel that uses less data compression and provides better sound quality at the selected audio playback speed.

If a decision step 530 determines that the event was the user changing the time scale of the presentation, application 500 branches from step 530 to step 532, which changes the channel index to a value corresponding to the selected time scale. The previously determined amount of network traffic can be used in selecting the channel that provides the best audio quality for the selected time scale and the available network bandwidth.

After step 532 changes the channel index, step 526 then resets the playback buffer, and dequeues all audio frames in the playback buffer, except the current audio frame. After resetting the playback buffer, process 500 maintains the playback buffer, the audio output, and the video display as described above for steps 550, 560, and 570.

In maintaining the audio steam in step 560, the current audio frame continues to provide data for audio output until that data is exhausted. Accordingly, audio output continues at the old rate until the data from the current audio frame is exhausted. At that point, an audio frame that corresponds to the next frame index but is from audio channel corresponding to the new channel index should be available. The playback of the presentation thus switches to the new playback rate in less than the duration of a single frame, e.g., in less than 0.5 second in an exemplary embodiment. Additionally, the content of the frame at the next frame index in the new channel corresponds to the audio data immediately following the frame corresponding to the old playback rate. Accordingly, the user perceives smooth, real-time transition in the playback rate.

If the frame corresponding to the next frame index is unavailable when required, process 500 pauses playback until the user receives the required data from the source and step 550 queues the data frame in the playback buffer. An alternative embodiment of the invention retains and uses the series of audio frames that are queued in the playback buffer for the old playback rate, instead of dequeuing those frames as in step 526. The old audio frames can thus be played to avoid pausing the presentation when application 500 does not receive the required frame in time. This continuation of the old rate undesirably provides the appearance of the process being non-responsive and is avoided by the embodiment of FIG. 5.

If instead of starting a new presentation or changing the speed, the user selects a bookmark or slide or selects a fast forward or fast backward, a decision step 540 causes application 540 to branch to process 542, which changes the current frame index. The new value for the current frame index depends on the action the user took. If the user selected fast forward or fast backward, the current frame index is increased or decreased by a fixed amount. If the user selected a bookmark or a slide, the current frame index is changed to a start index value associated with the selected bookmark or slide. In the exemplary embodiment, the start index value is among the data in that step 524 loaded from the header for the multi-channel file.

Following the change in current frame index, a process 544 shifts the queue of the playback buffer to reflect the new value of the current frame index. If the change in the frame index is not too great, some of the series of audio frames commencing with the new frame index value may already be queued in the playback buffer. Otherwise, shift process 544 is the same as the reset process 526 for the playback buffer.

Figure 6:
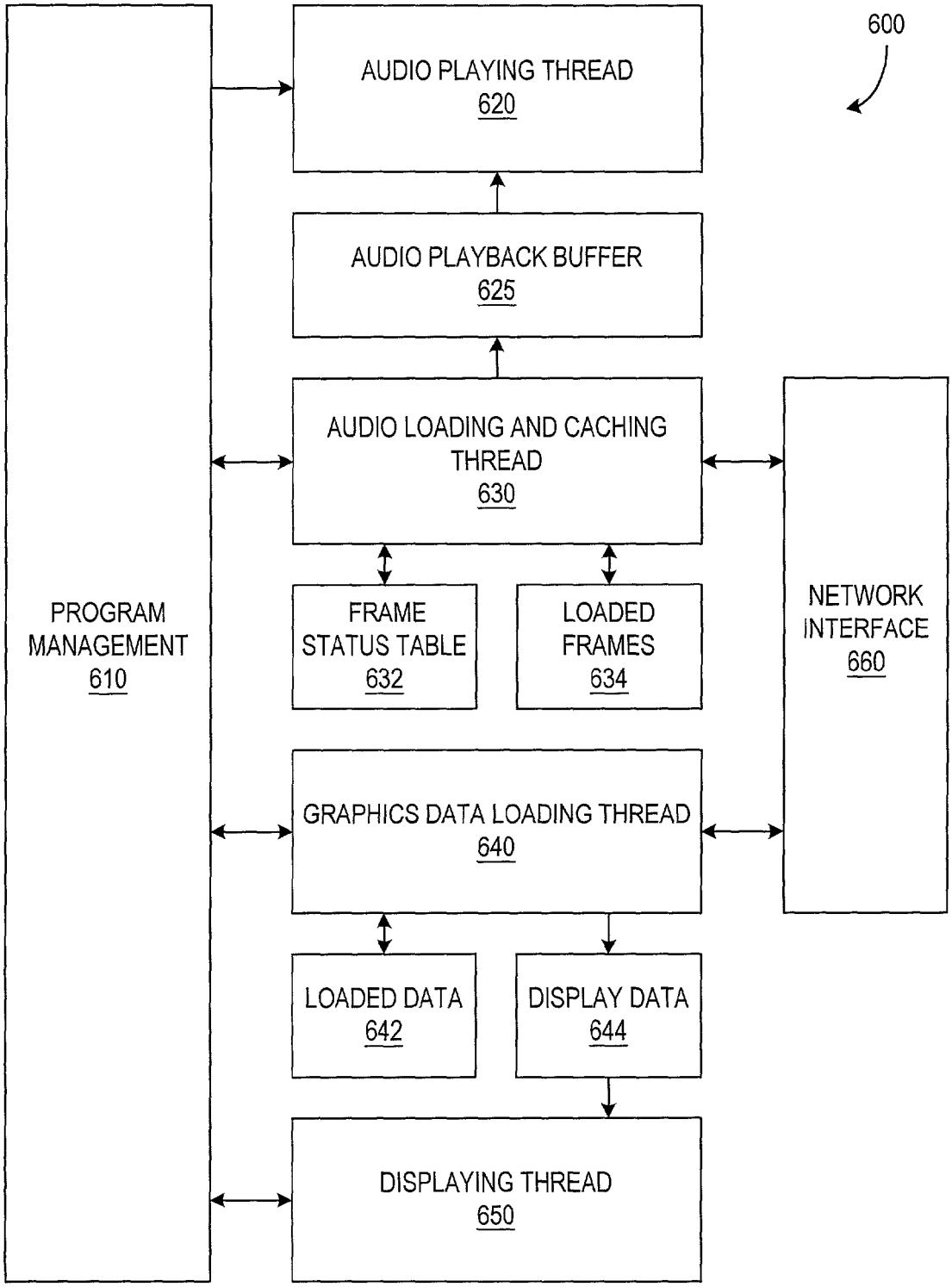
FIG. 6 is a block diagram illustrating operation of a presentation player in accordance with an embodiment of the invention.

FIG. 6 is a block diagram illustrating a multi-threaded architecture for a presentation player 600 in accordance with another embodiment of the invention. Presentation player 600 includes an audio playing thread 620, an audio loading and caching thread 630, a graphics data loading thread 640, and a displaying thread 650, which are under control of program management 610. Generally, presentation player 600 is executed in a computing system with a network connection such as a personal computer or PDA (personal digital assistant) connected to the Internet or a LAN or a cellular telephone connected to a telephone network.

When activated, audio playing thread 620 uses data from a playback buffer 625 to generate a sound signal for the audio portion of the presentation. In one embodiment, audio playback buffer 625 contains audio frames in compressed form, and audio playing thread 620 decompresses the audio frames. Alternatively, playback buffer 625 contains uncompressed audio data.

Audio loading and caching thread communicates with the source of the presentation via a network interface 660 and fills audio playback buffer 625. Additionally, audio loading and caching thread 630 preloads audio frames into active memory of the computing system and controls caching of audio frames to a hard disk or other memory device. Thread 630 uses a frame status table 632 to track the status of the audio frames making up the presentation and can initially construct frame status table 632 from the header of a multi-channel file such as described above. Thread 630 changes frame status table 632 as the status of each audio frame changes to indicate, for example, whether an audio frame is loaded in active memory, is loaded and cached locally on disk, or has not been loaded.

In an exemplary embodiment of the invention, audio loading and caching thread 630 pre-loads a series of audio frames corresponding to the currently selected time scale. In particular, thread 630 pre-loads a series of audio frames at the beginning of the presentation and other series of frames starting with the starting frame index values of the bookmarks of the presentation. Accordingly, if a user jumps to a location in the presentation corresponding to a bookmark, presentation player 600 can quickly transition to the bookmark location without a delay for loading audio frames via network interface 660.

When the user changes the time scale of the presentation, audio playback buffer 625 is reset, and audio loading and caching thread 630 begins loading frames from a new channel that corresponds to the new time scale. In the exemplary embodiment, program management 610 does not activate audio playing thread 620 until audio playback buffer 625 contains a user-selected amount of data, e.g., 2.5 seconds of audio data. Delaying activation avoids the need to repeatedly stop audio playing thread 610 if network transmission of audio frames is irregular. Generally, audio loading and caching thread 630 selects an audio channel having a high compression rate when playback buffer 625 is empty or nearly empty and can switch to a channel providing better audio quality when playback buffer 625 contains an adequate amount of data.

Graphics data loading thread 640 and displaying thread 650 respectively load graphics data and display graphics images. Graphics data loading thread 640 can load the graphics data into a data buffer 642 and prepare display data 644 for displaying thread 650. In particular, when the graphics data is a link to network data such as a web page, graphics data loading thread 640 receives the link from the source of the presentation via network interface 660 and then accesses the data associated with the link to obtain display data 644. Alternatively, graphics data loading thread 640 directly uses embedded image data from the source of the presentation as display data 644.

In accordance with an aspect of the invention, playing of the presentation keys around the audio. Accordingly, program management 610 gives highest priority to audio loading and caching thread 630. However, in some embodiments, audio loading and caching thread 630 can select an audio channel having high compression to free more bandwidth for graphics data. In particular, thread 630 can change to a higher compression audio channel sometime before the audio reaches the starting frame index for a bookmark to provide bandwidth for thread 640 to load new graphics data for display when audio plying thread 620 reaches the starting frame index.

The presentation players and authoring tools disclosed above can provide presentations that allow a user to make real-time changes in the playback rate or time scale of a presentation without having special hardware, a large amount of available processing power, or high-bandwidth network connection. Such presentations are useful in a variety of business, commercial, and educational contexts where the ability to change the playback rate is a convenience. However, the systems are also useful when changing the playback rate is not a concern. In particular, as noted above, some embodiments of the authoring tool create a presentation suitable for access on any server implementing a recognized protocol such as the http protocol. Accordingly, even a casual author can record an audio message and use the authoring tool to synchronize images to the audio message, thereby creating a personal presentation for family or friends. A recipient of the presentation can play the presentation without special hardware or a high-bandwidth network connection.

Figure 7:
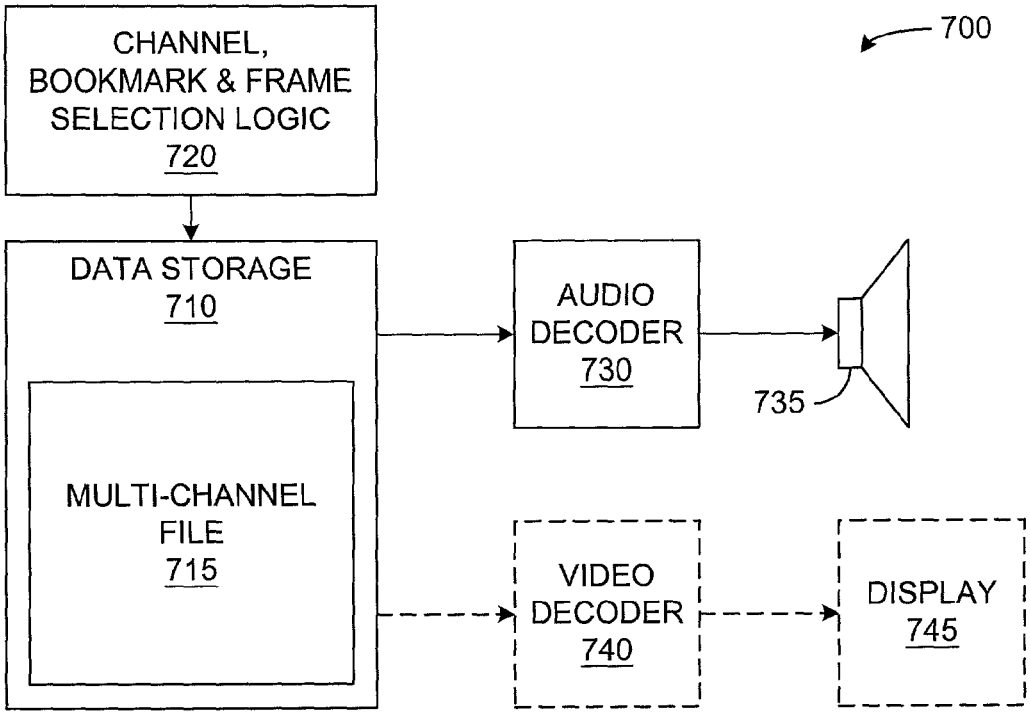
FIG. 7 is a block diagram of a standalone presentation player in accordance with an embodiment of the invention.

Aspects of the present invention can also be employed in a standalone system where a network connection is not a concern but processing power or battery power may be limited. FIG. 7 shows a standalone system 700 that gives a user real-time control over the time scale or playback rate of a presentation. Standalone system 700 can be a portable device such as a PDA or portable computer or a specially designed presentation player. System 700 includes data storage 710, selection logic 720, an audio decoder 730, and an video decoder 740.

Data storage 710 can be any medium capable of storing a multi-channel file 715 representing a presentation as described above. For example, in a PDA, data storage 710 can be a Flash disk or other similar device. Alternatively, data storage 710 can include a disk player and a CD-ROM or other similar media. In standalone system 700, data storage 710 provides the audio data and any graphics data so that a network connection is not required.

Audio decoder 730 receives an audio data stream from data storage 710 and converts the audio data stream into an audio signal that can be played through an amplifier and speaker system 735. To minimize required processing power, multi-channel file 715 contains uncompressed digital audio data, and audio decoder 730 is a conventional digital-to-analog converter. Alternatively, audio decoder 730 can decompress data if system 700 is designed for multi-channel file 715 containing compressed audio data. Similarly, data storage 710 provides any graphics data from multi-channel file 715 to an optional video decoder 740 that converts the graphics data as required for a display 745.

Selection logic 720 selects data streams that data storage 710 provides to audio decoder 730 and video decoder 740. Selection logic 720 includes buttons, switches, or other user interface devices for used control of system 700. When a user changes a playback rate, selection logic 720 directs data storage 710 to switch to a channel in multi-channel file 715 corresponding to the new playback rate. When a user selects a bookmark, selection logic 720 directs data storage 710 to jump to a frame index corresponding to the bookmark and resume the audio and video data streams from the new time index. Selection logic 720 requires little or no processing power since the selection of a time scale or bookmark requires only changes the parameters (e.g., a channel or frame index) that data storage 710 uses in reading the audio and graphics data streams from multi-channel file 715.

Standalone system 700 does not consume processing power for any time scaling because the audio channels of multi-channel file 715 already include time-scaled audio data. Accordingly, standalone system 700 consumes very little battery or processing power and still can provide a time-scaled presentation with real-time user changes in the time-scale. In a specially designed presentation player, standalone system 700 can be a low cost device because system 700 does not require significant processing hardware.

Although the invention has been described with reference to particular embodiments, the description is only an example of the invention's application and should not be taken as a limitation. Various adaptations and combinations of features of the embodiments disclosed are within the scope of the invention as defined by the following claims.

I claim:

1. An apparatus containing a data structure representing a presentation, the data structure comprising:

a first audio channel representing an audio portion of the presentation after time scaling by a first time scale factor, wherein the first audio channel comprises a plurality of frames;

a second audio channel representing the audio portion after time scaling by a second time scale factor that differs from the first time scale factor, wherein the second audio channel comprises a plurality of frames that are in one-to-one correspondence with the plurality of frames in the first audio channel, and corresponding frames in the first and second audio channels represent the same time interval of the presentation;

wherein each frame in the first audio channel is separately compressed using a first compression method; and wherein the data structure further comprises a third audio channel representing the audio portion of the presentation after time scaling by the first time scale factor, wherein each frame in the third audio channel is separately compressed using a second compression method.

2. The apparatus of claim 1, wherein the data structure further comprises a data channel identifying graphics associated with the audio portion of the presentation.

3. The apparatus of claim 1, wherein:

each frame in the first audio channel has an index value that identifies a time interval of the audio portion that the frame represents; and each frame in the second audio channel has an index value that identifies a time interval of the audio portion that the frame represents.

4. The apparatus of claim 3, wherein each frame in the first and second data channels is separately compressed.

5. The apparatus of claim 3, wherein the data structure further comprises a data channel corresponding to a plurality of bookmarks, wherein each bookmark has an index value and identifies graphics, the index value indicating a display time for the graphics relative to playing of the frames of the first or second audio channel.

6. The apparatus of claim 1, wherein the apparatus comprises a server connected to a network.

7. The apparatus of claim 1, wherein the apparatus comprises:

data storage in which the data structure is stored;

a decoder connected to receive a data stream from the data storage, the decoder converting the data stream for perceivable presentation; and selection logic coupled to the data storage and capable of selecting a source channel for the data stream from among a set of channels including the first audio channel and the second audio channel.

8. The apparatus of claim 7, wherein the apparatus is a standalone device that operates on battery power.

9. A method for encoding audio data, comprising:

performing a plurality of time scaling processes on the audio data to generate a plurality of time-scaled audio data sets, each time-scaled audio data set having a different time scale factor;

partitioning each time-scaled audio data set into a plurality of frames, wherein all frames resulting from the partitioning correspond to the same amount of time in the audio data;

separately compressing each frame to produce compressed frames; and collecting the compressed frames into a plurality of audio channels that form a data structure, each audio channel having a corresponding one of the different time scale factors;

wherein separately compressing each frame comprises applying a plurality of different compression processes to generate a plurality of compressed frames from each frame.

10. The method of claim 9, wherein collecting the compressed frames produces audio channels such that in each audio channel, all compressed frames in the audio channel have the same time scale and compression process.

* * * * *